US010344950B2

(12) United States Patent
Van Bommel et al.

(10) Patent No.: US 10,344,950 B2
(45) Date of Patent: Jul. 9, 2019

(54) LIGHT EMITTING ARRANGEMENT WITH CONTROLLED SPECTRAL PROPERTIES AND ANGULAR DISTRIBUTION

(71) Applicant: SIGNIFY HOLDING B.V., Eindhoven (NL)

(72) Inventors: Ties Van Bommel, Horst (NL); Rifat Ata Mustafa Hikmet, Eindhoven (NL)

(73) Assignee: SIGNIFY HOLDING B.V., Eindhoven (NL)

( * ) Notice: Subject to any disclaimer, the term of this patent is extended or adjusted under 35 U.S.C. 154(b) by 57 days.

(21) Appl. No.: 14/646,551

(22) PCT Filed: Nov. 28, 2013

(86) PCT No.: PCT/IB2013/060466

§ 371 (c)(1),
(2) Date: May 21, 2015

(87) PCT Pub. No.: WO2014/083523

PCT Pub. Date: Jun. 5, 2014

(65) Prior Publication Data

US 2015/0300602 A1 Oct. 22, 2015

Related U.S. Application Data

(60) Provisional application No. 61/730,626, filed on Nov. 28, 2012.

(51) Int. Cl.
*F21V 11/00* (2015.01)
*F21V 13/08* (2006.01)
(Continued)

(52) U.S. Cl.
CPC ..... *F21V 13/08* (2013.01); *F21K 9/62* (2016.08); *F21K 9/64* (2016.08); *F21S 8/085* (2013.01);
(Continued)

(58) Field of Classification Search
CPC . F21V 7/048; F21V 7/016; F21S 8/085; F21S 8/086; F21S 8/088; F21Y 2113/10; F21Y 2113/13; F21Y 2113/17
(Continued)

(56) References Cited

U.S. PATENT DOCUMENTS 5,014,175 A * 5/1991 Osteen ..... F21S 8/04 362/297
2009/0175038 A1* 7/2009 Rooymans ..... F21K 9/00 362/249.02
(Continued)

FOREIGN PATENT DOCUMENTS

CN 101689588 A 3/2010
EP 2088362 A1 8/2009
(Continued)

OTHER PUBLICATIONS

"Human Eye Sensitivity and Photometric Quantities", pp. 1-17.RPI.edu www.esce.rpi.edu/~schubert/Light-Emitting-Diodes-dot-org/Sample-Chapter.pdf.

*Primary Examiner* — Matthew J. Peerce
(74) *Attorney, Agent, or Firm* — Akarsh P. Belagodu

(57) ABSTRACT

A light emitting arrangement comprises: —a plurality of solid state light sources, forming at least one group of light sources, arranged to provide a light distribution comprising a first light portion and a second light portion, and —at least one optical component adapted to at least partly collimate light emitted by said light sources, to yield output light exiting the light emitting arrangement comprising central output light and peripheral output light, wherein said central output has a dominant wavelength of 555±20 nm and a light intensity of at least 3 cd/m2, and said peripheral output light has a dominant wavelength of 507±30 nm and a light intensity of less than 3 cd/m2. The light emitting arrangement thus provides an emission spectrum which is related to
(Continued)

the intensity and the direction of emitted light, and can be adapted to enhance the visibility of objects and colors directly beneath the light emitting arrangement as well as at a distance therefrom. The light emitting arrangement is therefore particularly well suited for outdoor illumination at poor ambient light conditions, such as at dawn, dusk, and dark.

16 Claims, 2 Drawing Sheets

(51) Int. Cl.

| | |
|---|---|
| ***F21S 8/08*** | (2006.01) |
| ***F21V 13/14*** | (2006.01) |
| ***F21K 9/62*** | (2016.01) |
| ***F21K 9/64*** | (2016.01) |
| ***F21S 41/20*** | (2018.01) |
| ***F21S 41/32*** | (2018.01) |
| *F21W 131/103* | (2006.01) |
| *F21W 131/10* | (2006.01) |
| *F21Y 105/10* | (2016.01) |
| *F21Y 115/10* | (2016.01) |
| *F21W 102/00* | (2018.01) |

(52) U.S. Cl.
CPC ..... *F21S 8/086* (2013.01); *F21S 41/285* (2018.01); *F21S 41/32* (2018.01); *F21V 13/14* (2013.01); *F21W 2102/00* (2018.01); *F21W 2131/10* (2013.01); *F21W 2131/103* (2013.01); *F21Y 2105/10* (2016.08); *F21Y 2115/10* (2016.08)

(58) Field of Classification Search
USPC ..... 362/510
See application file for complete search history.

(56) References Cited

U.S. PATENT DOCUMENTS

| | | | | |
|---|---|---|---|---|
| 2010/0321930 | A1* | 12/2010 | Watanabe | F21S 8/086 362/184 |
| 2012/0287618 | A1 | 11/2012 | Saito | |
| 2013/0093362 | A1* | 4/2013 | Edwards | H01L 25/0753 315/313 |

FOREIGN PATENT DOCUMENTS

| | | | |
|---|---|---|---|
| EP | 2202444 | A1 | 6/2010 |
| JP | 2010514209 | A | 5/2007 |
| JP | 2012022986 | A | 7/2010 |
| JP | 2012084457 | A | 4/2012 |
| WO | 200101037 | A1 | 1/2001 |
| WO | 2006132533 | A2 | 12/2006 |
| WO | 2011033394 | A1 | 3/2011 |
| WO | 2013050918 | A1 | 4/2013 |

* cited by examiner

LIGHT EMITTING ARRANGEMENT WITH CONTROLLED SPECTRAL PROPERTIES AND ANGULAR DISTRIBUTION

CROSS-REFERENCE TO PRIOR APPLICATIONS

This application is the U.S. National Phase application under 35 U.S.C. § 371 of International Application No. PCT/IB13/060466, filed on Nov. 28, 2013, which claims the benefit of U.S. Provisional Patent Application No. 61/730,626, filed on Nov. 28, 2012. These applications are hereby incorporated by reference herein.

FIELD OF THE INVENTION

The present invention relates to light emitting arrangements comprising solid state light sources adapted to provide output light having desirable spectral properties and angular distribution.

BACKGROUND OF THE INVENTION

The sensitivity of the human eye is dependent on the light intensity conditions. At low light intensities, <0.01 cd/m$^2$, referred to as scotopic conditions, at which vision is mediated by rod cells, the eye is more sensitive to relatively short wavelengths, with a sensitivity peak at around 507 nm. In contrast, at high light intensity conditions, >3 cd/m$^2$, referred to as photopic conditions and at which vision is mediated mainly by cone cells, the eye is more sensitive to longer wavelengths, with a sensitivity peak at 555 nm.

WO 2006/132533 aims to provide a lighting arrangement for public spaces which combines high efficiency with good visibility at night-time. To this end WO 2006/132533 proposes a lighting arrangement comprising a solid-state light source suitable for generating light of a first wavelength region and a second wavelength region. The first wavelength region comprises wavelengths of 500-550 nm, and the second wavelength region comprises wavelengths of 560-610 nm. The lighting arrangement is designed to generate light having a dominant wavelength from the first wavelength region in such a way that the eye sensitivity of the human eye is dominated by rods (i.e. scotopic vision).

However, a drawback of the solution proposed in WO 2006/132533 is that at positions directly below the lighting arrangement, color recognition is still unsatisfactory. Hence, there is a need in the art for improved lighting arrangements that are suitable for outdoor lighting.

SUMMARY OF THE INVENTION

It is an object of the present invention to overcome this problem, and to provide a light emitting arrangement which enhances the visibility of objects and/or colors directly beneath the light emitting arrangement as well as at a distance therefrom.

According to a first aspect of the invention, this and other objects are achieved by a light emitting arrangement, comprising

- a plurality of solid state light sources, forming at least one group of light sources, arranged to provide a light distribution comprising a first light portion and a second light portion, and
- at least one optical component adapted to at least partly collimate light emitted by said light sources, to yield output light exiting the light emitting arrangement comprising central output light and peripheral output light, wherein said central output has a dominant wavelength of 555±20 nm and a light intensity of at least 3 cd/m$^2$, and said peripheral output light has a dominant wavelength of 507±30 nm and a light intensity of less than 3 cd/m$^2$.

The light emitting arrangement of the invention is particularly well suited for outdoor illumination at poor ambient light conditions, such as at dawn, dusk, and dark. Directly in front (in the case of a downlight, beneath) of the light emitting arrangement, the emitted wavelengths are adapted to match the eye's sensitivity at photopic conditions, such that color vision is enhanced. At the same time, in peripheral regions of the emitted light, where the intensity is lower, the emitted wavelengths are adapted to closely match the sensitivity of the eye at scotopic conditions, so as to also provide good visibility of objects more distant from the light source.

In embodiments of the invention, at least some of said solid state light sources may be adapted to emit light of a first wavelength range. The light emitting arrangement then further comprises at least a first wavelength converting member capable of converting light of said first wavelength range into light of a second wavelength range. The wavelength converting member is typically arranged to receive and at least partially convert said first light portion emitted by said plurality of solid state light sources, and to allow said second light portion emitted by said solid state light sources to pass beside said first wavelength converting member. For example, light emitted by at least one first solid state light source may be received by the first wavelength converting member, and light emitted by at least one second solid state light source may avoid (e.g., may pass beside) said first wavelength converting member.

The first wavelength range may have a dominant wavelength of 507±30 nm.

In embodiments of the invention, the light emitting arrangement may comprise a first group of solid state light sources for providing said first light portion and said central portion of output light, and a second group of solid state light sources for providing said second light portion and said peripheral portion of output light.

In embodiments of the invention, the at least one first solid state light source may be arranged within a first light mixing chamber and the wavelength converting member may form a light exit window of said light mixing chamber, and said at least one second solid state light source may be arranged outside of said first light mixing chamber. In some embodiments, the at least one second solid state light source may be arranged within a second light mixing chamber.

In embodiments of the invention, the wavelength converting member may cover said at least one first solid state light source.

In embodiments of the invention, the light emitting arrangements further comprising a second wavelength converting member arranged to receive said peripheral light portion and comprising a second wavelength converting material capable of converting light of said first wavelength range into light of a third wavelength range. The third wavelength range may have a dominant wavelength of 507±30 nm. Using a wavelength converting material to provide the desired wavelengths for scotopic light conditions allows the use of light sources having a different emission spectrum.

In embodiments of the invention, the light emitting arrangement may comprise a first optical component arranged to at least partly collimate said first light portion to form said central output light, and a second optical component arranged to at least partly collimate said second light portion to form said peripheral output light, wherein said second optical component provides a wider angular distribution of light than said first optical component. Hence, light from the light sources can be effectively directed to form said central and peripheral portions, respectively.

In embodiments of the invention using a wavelength converting member, the light emitting arrangement may comprise a first reflector or a refractive optical component arranged to direct light of said second wavelength range towards a central light exit window of the light emitting arrangement, to form said central output light.

Furthermore, in embodiments of the invention using a wavelength converting member, the light emitting arrangement may comprise a second reflector or second refractive optical component arranged to direct light of said second light portion towards an outer light exit window of the light emitting arrangement, to form said peripheral output light. "Second" in this context is used for referring to its position and/or function, and is not to be construed as requiring a "first" reflector or refractive optical component; it is envisaged that the light emitting arrangement may comprise said second reflector or second refractive optical component arranged to direct light of said second light portion towards an outer light exit window, without there being a first reflector or component as described above.

In embodiments of the invention, said first optical component may be arranged in optical contact with a first light source, and said second optical component may be arranged in optical contact with a second light source.

In embodiments of the invention, the wavelength converting member may comprise quantum dots. Where also a second wavelength converting member is used, one or both wavelength converting members may comprise quantum dots. Quantum dots have well-defined, narrow emission bands, which makes them particularly suitable for use in the present invention where dominant wavelength of, for example, 555±20 nm is desired.

In embodiments of the invention, the first wavelength converting member and the solid state light sources are mutually spaced apart. Alternatively, in some embodiments, the first wavelength converting member may be arranged directly on at least one of said solid state light sources.

According to another aspect, the present invention provides a lamp or luminaire comprising a light emitting arrangement as described herein.

According to yet another aspect, the invention provides street light comprising a light emitting arrangement as described herein. The street light may provide an emission spectrum which is related to the intensity and the direction of emitted light, and which may be adapted to enhance the visibility of objects and colors directly beneath the light emitting arrangement as well as at a distance therefrom. The street light may thus provide increased comfort and safety for drivers as well as pedestrians.

According to further aspects, the invention provides a torch light and a headlight for a vehicle, in particular a bicycle lamp, respectively, comprising a light emitting arrangement as described herein. Since torch lights and bicycle lamps are primarily used at poor ambient light conditions, the present light emitting arrangement may be highly useful also in such applications.

It is noted that the invention relates to all possible combinations of features recited in the claims.

BRIEF DESCRIPTION OF THE DRAWINGS

This and other aspects of the present invention will now be described in more detail, with reference to the appended drawings showing embodiment(s) of the invention.

DETAILED DESCRIPTION

Figure 1:
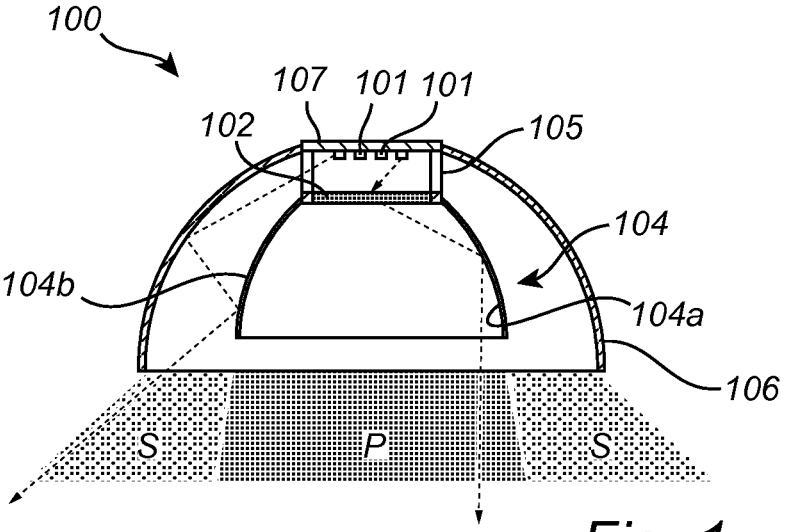
FIG. 1 is a cross-sectional side view of a light emitting arrangement, providing different regions of light adapted for photopic and scotopic conditions, respectively according to embodiments of the invention.

The present invention will now be described more fully hereinafter with reference to the accompanying drawings, in which currently preferred embodiments of the invention are shown. This invention may, however, be embodied in many different forms and should not be construed as limited to the embodiments set forth herein; rather, these embodiments are provided for thoroughness and completeness, and fully convey the scope of the invention to the skilled person. Like reference numerals refer to like elements throughout.

The present inventors have developed a light emitting arrangement which is particularly well suited for illumination (especially outdoor) at poor ambient light conditions, such as at dawn, dusk, and dark. The present light emitting arrangement provides an emission spectrum which is related to the intensity and the direction of emitted light, and can be adapted to enhance the visibility of objects and colors directly beneath the light emitting arrangement as well as at a distance therefrom.

FIG. 1 illustrates an embodiment of a light emitting arrangement that can be used to provide desirable photopic and scotopic light spectra. The light emitting arrangement 100 comprises a plurality of solid state light sources 101 arranged on a support 107. In front of the light sources 101, a first wavelength converting member 102 is arranged in order to receive a central portion of the light emitted by the group of light sources 101. The converted light exiting the wavelength converting member is subsequently partially redirected by a concave surface 104*a* of central reflector 104 so that wavelength-converted light, and any non-converted light that is transmitted though the wavelength converting member 102 without being converted, may exit the light emitting arrangement as central output light.

According to embodiments of the invention, the central portion of light emitted by the light emitting arrangement is photopic light, having an intensity of at least 3 cd/m$^2$, and has a dominant wavelength of 555 nm±20 nm, i.e. in the wavelength range of 535-575 nm. Typically this photopic light may be white or whitish light.

Furthermore, light emitted by the light sources 101 in a peripheral direction avoids the wavelength converting member 102, optionally via at least one lateral light exit window, and is subsequently redirected by a peripheral concave reflector 106 surrounding, the central reflector, e.g. concentrically. Optionally this peripheral, non-converted light is typically also redirected by the convex outer surface 104*b* of the central reflector 104. As a result, non-converted light of low intensity, i.e. scotopic light (S) may exit the light emitting arrangement in a peripheral direction. The peripheral light typically has a dominant wavelength of 507 nm±30 nm.

Thus, according to embodiments of the invention, a peripheral portion of the light emitted by the light emitting arrangement 100 is scotopic light (S), having an intensity of less than 0.01 cd/m$^2$, and has a dominant wavelength of 507 nm±30 nm, i.e. in the wavelength range of 477-537 nm. The scotopic light may be white or whitish light.

The wavelength converting member 102 comprises at least one wavelength converting material, which is selected with regard to the wavelength range that is to be converted, and the desired conversion wavelength range and the desired dominant wavelength of the output light, which may be a combination of converted, and non-converted (transmitted) light. For example, light of the second wavelength range (converted light) may have a dominant wavelength of 555 nm±20 nm.

Figure 2:
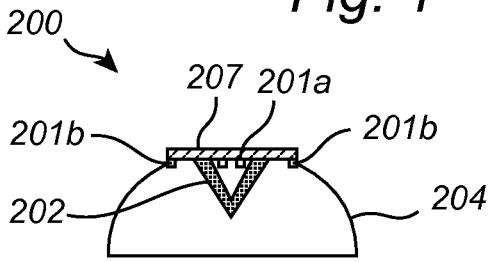
FIG. 2 is a cross-sectional view of side view of a light emitting arrangement according to other embodiments of the invention.
Figure 3:
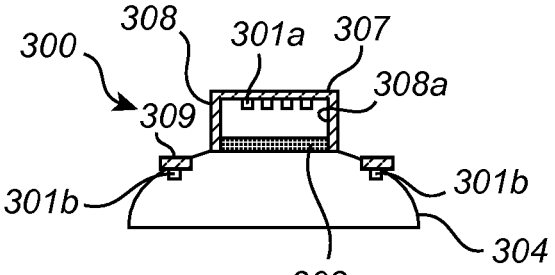
FIG. 3 is a cross-sectional view of side view of a light emitting arrangement according to other embodiments of the invention.

According to the present invention there are various solutions for providing light having a dominant wavelength of 507 nm±30 nm. In the embodiment illustrates in FIG. 1, the light sources 101 are adapted to emit light of a first wavelength range, having a dominant wavelength of 507 nm±30 nm. In other embodiments however, the light emitted by the light sources, corresponding to the "first wavelength range", may be light of shorter wavelength, typically blue light, and a second wavelength converting member may be provided instead of the transparent lateral light exit window 105, said second wavelength converting member being capable of converting part of the (e.g., blue) light emitted by the light sources 101 into light having a dominant wavelength of 507 nm±30 nm. In these embodiments, the wavelength converting member 102 still converts said first wavelength range into said second wavelength range. FIG. 2 shows another embodiment of a light emitting arrangement of the present invention. Here a light emitting arrangement 200 comprises two groups of light sources: a first group of light sources 201*a*, also referred to as central light sources 201*a*, is arranged centrally on a support plate 207. A wedge-shaped wavelength converting member 202 is arranged over the light sources 202*a* to receive all light emitted by the light sources 201*a*. The wedge points in the direction of light emission, and the lateral sides of the wavelength converting member 202 face towards the periphery of the light emitting arrangement. Alternatively, the wavelength converting member 202 may have the shape of a pyramid a half-sphere or half-cylinder. The light exiting the wavelength converting member 202 is partially redirected by a concave reflector 204 to form central output light, typically having a dominant wavelength of 555 nm±20 nm. The light emitting arrangement further comprises a second group of light sources 201*b*, which are arranged peripherally on the support plate 207. The peripheral light sources 201*b* are not covered by the wavelength converting member 202, and the light emitted by the peripheral light sources 201*b* mainly exits the light emitting arrangement without being redirected by the reflector 204. The light sources 201*a* may be adapted to emit light of any suitable wavelength that can be converted by the wavelength converting member 202 into said second wavelength range. For example, the light sources 201*a* may emit blue light, or light having a dominant wavelength of 507 nm±30 nm. The light sources 201*b* may be adapted to emit light of having a dominant wavelength of 507 nm±30 nm. Alternatively, the light sources 201*b* may emit light of different (typically shorter) wavelength range, and a second wavelength converting member capable of converting e.g. the emitted light into light having a dominant wavelength of 507 nm±30 nm may be arranged directly on top of one or more of the light sources 201*b*. In another embodiment, illustrated in FIG. 3, the light emitting arrangement 300 comprises a first, central group of light sources 301*a* for emitting light of the first wavelength range, arranged in a light mixing chamber 308 defined bottom support 307, at least one reflective wall 308*a* and a wavelength converting member 302 forming a light exit window. A reflector 304, here a concave reflector cup, is arranged around the light exit window to at least partially redirect the light exiting the light mixing chamber via the light exit window (i.e., the wavelength converting member). The at least partially wavelength-converted light, comprising light of the second wavelength range, exiting the light mixing chamber thus provides a central portion of the light emitted by the light emitting arrangement, said central portion having a dominant wavelength of 555 nm±20 nm. Further, a second group of light sources 301*b* for emitting peripheral light are arranged outside of the light mixing chamber, and the light emitted by the light sources 301*b* thus avoids being converted by the wavelength converting member 302. As illustrated in the figure, the light sources 301*b* may be arranged on at least one support member 309, which may be mounted for instance inside or on an inner surface of the reflector 304. The second group of light sources 301*b* provides peripheral light.

The light sources 301*a* may be adapted to emit light of any suitable wavelength that can be converted by the wavelength converting member 302 into said second wavelength range. For example the light sources 301*a* may emit blue light, or light having a dominant wavelength of 507 nm±30 nm. The light sources 301*b* may be adapted to emit light of having a dominant wavelength of 507 nm±30 nm. In some embodiments, the light sources 301*b* may be direct-phosphor-converted light sources as described above with reference to the light sources 201*b*, for example blue light emitting light sources having a wavelength converting member arranged directly on top of the light source 301*b* for conversion into light having dominant wavelength of 507 nm±30 nm.

Figure 4:
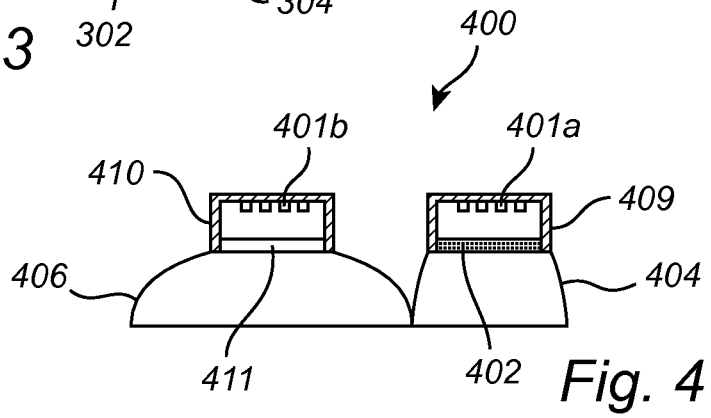
FIG. 4 is a cross-sectional view of side view of a light emitting arrangement according to other embodiments of the invention.

In yet another embodiment, illustrated in FIG. 4, the light emitting arrangement comprises at least two separate light mixing chambers: a first light mixing chamber 409 comprising a first group of light sources 401*a*, and a second light mixing chamber 410 comprising a second group of light sources 401*b*. The first light mixing chamber comprises a reflective support, at least one reflective side wall, and a first wavelength converting member 402 forming a light exit window. A first optical component 404, here a first reflector, is arranged outside and around the light exit window to partially redirect the light exiting the first light mixing chamber 409. The light exiting the light mixing chamber may be substantially collimated by the reflector 404. A second optical component 406, here a second reflector, provides a collimation which leads to lower degree of light collimation, such that light is distributed at larger angles than the light distribution produced by reflector 404. In embodiments of the invention, one or both of optical components 404, 406 may be refractive optical elements, such as TIR optics.

The second light mixing chamber 410 comprises a reflective support, at least one reflective side wall, and a transparent light exit window 411. For example, the transparent light exit window may comprise a transparent plate. Outside and around the transparent light exit window 411 a second reflector 46 is arranged to at least partially redirect the light exiting the second light mixing chamber.

In some embodiments, the light sources 401*a* may emit light having a dominant wavelength of 555 nm±20 nm whereas light sources 401*b* may emit light having a dominant wavelength of 507 nm±30 nm. In that case, the wavelength converting member 402 may be replaced with a transparent light exit window 402. Furthermore, the light sources 401*a* and 401*b* may emit light of any wavelength range, if suitably combined with first and/or second wavelength converting members at the position of the wavelength converting member 402 and/or the transparent light exit window 411, so that the resulting output light has the desired spectral characteristics. In some embodiments, one or both light mixing chambers 409, 410 may comprise a further wavelength converting element 403, which may be arranged to replace at least part of the reflective side wall.

Figure 5:
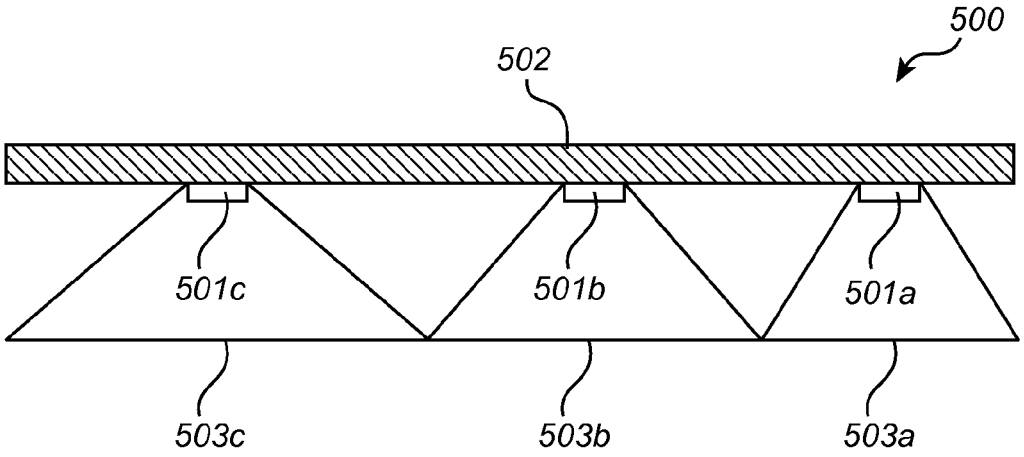
FIG. 5 illustrates a light emitting arrangement having a plurality of individual light sources each associated with a respective optical element to provide a degree of collimation of light.

In yet another embodiment of the invention, illustrated in FIG. 5, the light emitting arrangement 500 comprises a plurality of individual solid state light sources 501*a*, 501*b*, 501*c* are arranged on a support 502. Each light source 501*a*, 501*b*, 501*c* is used in combination with a respective optical component 503*a*, 503*b*, 503*c* providing the desirable degree of collimation of light. For instance, the light source 501*a*, intended to provide the central portion of light exiting the light emitting arrangement are associated with an optical component 503*a* which provides a higher degree of collimation, compared to the optical component 503*c*, which is associated with a light source 501*c* adapted for providing the peripheral light exiting the light emitting arrangement. The optical components 503*a-c* may be so-called TIR optics, directing at the light by total internal reflection (TIR).

The light sources 501*a-c* may be adapted to emit light having the desirable spectral characteristics. Thus, a light source intended to provide the peripheral light may emit light having a dominant wavelength of 507 nm±30 nm, and a light source intended to provide central light may emit light having a dominant wavelength of 555 nm±20 nm. Alternatively, some or all of the light sources may be direct-converted light sources as described above with reference to FIGS. 2 and 3. That is, the light source may emit light that is subsequently converted into the desired wavelength range by a wavelength converting member arranged directly on top of the light source. For example, all light sources may emit blue light which is converted into light having a dominant wavelength of 507 nm±30 nm or 555 nm±20 nm, respectively, by two different types of wavelength converting members. Alternatively, all light sources may emit light having a dominant wavelength of 507 nm±30 nm, and the light sources intended to provide the central light may be provided with a wavelength converting member capable of converting at least part of this light into the second wavelength range.

Thus, the desired light spectrum satisfying photopic and scotopic conditions may obtained directly at the light source, optionally using one or more direct-converted light sources, and collimating optics may be used for obtaining the desired angular light distribution from each light source.

Figure 6:
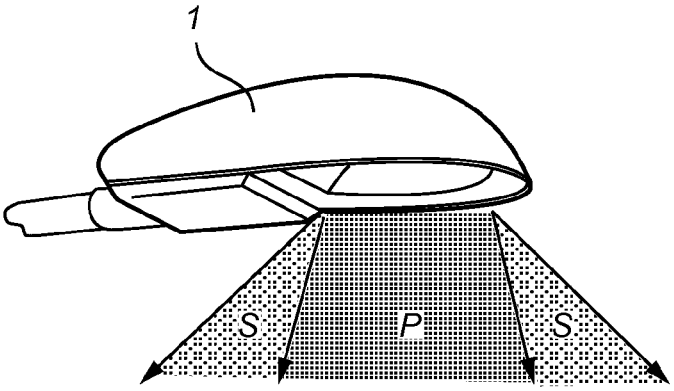
FIG. 6 illustrates a street lamp providing different regions of light adapted for photopic and scotopic conditions, respectively, according to embodiments of the invention.

FIG. 6 illustrates part of a street light 1 incorporating a light emitting arrangement according to embodiments of the present invention. Directly beneath the street light the lighting arrangement provides photopic light (P) (i.e. high intensity). At larger lateral distance from the light emitting arrangement the light intensity is weaker, resulting in scotopic (S) conditions. As described above, the central portion of light emitted by the light emitting arrangement typically has an intensity of at least 3 cd/m$^2$, and may have a dominant wavelength of 555 nm±20 nm, i.e. in the wavelength range of 535-575 nm. Typically this photopic light may be white or whitish light. Furthermore, the peripheral portion of the light emitted by the light emitting arrangement typically has an intensity of less than 0.01 cd/m$^2$, and may have a dominant wavelength of 507 nm±30 nm, i.e. in the wavelength range of 477-537 nm. This scotopic light may be white or whitish light.

Figure 7:
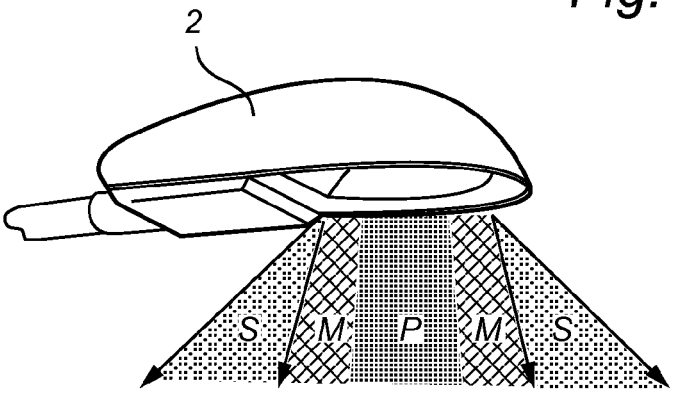
FIG. 7 illustrates a street lamp providing different regions of light adapted for photopic, mesopic and scotopic conditions, respectively, according to embodiments of the invention.

FIG. 7 illustrates part of a street light 2 incorporating a light emitting arrangement according to a further embodiment of the invention. Here, light emitted from the street light in a direction between a central portion and an outermost peripheral portion has an intensity in the range of from 0.01 to 3 cd/m$^2$, i.e. between scotopic and photopic conditions. Such light is referred to as mesopic light (M). According to embodiments of the invention, the light emitting arrangement may be adapted to emit semi-peripheral mesopic light, having an intensity of 0.01-3 cd/m$^2$, and having a dominant wavelength of 532±30 nm, i.e. in the range of from 502-562 nm. Such spectra and output light distribution can be achieved by adding an additional group of light sources and/or an additional wavelength converting element to any of the embodiments of FIG. 1-4, said additional light sources or additional wavelength converting member providing semi-peripheral light having a dominant wavelength of 532±30 nm. In the embodiment shown in FIG. 5, the middle light source 501*b*, optionally in combination with a direct phosphor, may be adapted to provide said mesopic light. Optionally also one or more reflectors or collimators may be used to adjust the angular distribution of light for the various output spectra, to obtain the light distribution shown in FIG. 7.

The light sources used in the present invention are solid state light sources, typically light emitting diodes (LEDs) or laser diodes.

As mentioned above, a wavelength converting member as described herein comprises a wavelength converting material capable converting light of the first wavelength range into a second wavelength range. The wavelength converting material is selected with regard to the first wavelength range, which is to be converted, and the second wavelength range and the desired dominant wavelength of the output light. In order to provide the narrow wavelength ranges or dominant wavelengths that are so useful for enhancing visibility under different light conditions, the wavelength converting member may comprise quantum dots.

Quantum dots, quantum rods or quantum tetrapods are small crystals of semiconducting material generally having a width or diameter of only a few nanometers. When excited by incident light, a quantum dot emits light of a color determined by the size and material of the crystal. Light of a particular color can therefore be produced by adapting the size of the quantum dots. In embodiments of the present invention, the quantum dots may for example have a size in the range of from 1 to 10 nm in at least one direction. As an alternative to quantum dots, quantum rods may be used, which may have a width in the range of from 1 to 10 nm and a length of up to 1 mm or more. Additionally, quantum dots have very narrow emission band, and thus show saturated colors.

Presently most quantum dots with emission in the visible range are based on cadmium selenide (CdSe) with shell such as cadmium sulfide (CdS) and zinc sulfide (ZnS). Cadmium free quantum dots such as indium phosphode (InP), and copper indium sulfide ($CuInS_2$) and/or silver indium sulfide ($AgInS_2$) can also be used. Any type of quantum dot known in the art may be used in the present invention, provided that it has the appropriate wavelength conversion characteristics. For example, in embodiments of the invention, quantum dots comprising CdSe, InP, $CuInS_2$, or $AgInS_2$ may be used. However, it may be preferred for reasons of environmental safety and concern to use cadmium-free quantum dots or at least quantum dots having a low cadmium content.

Alternatively, the wavelength converting member may comprise an organic or inorganic phosphor. Examples of organic phosphor materials suitable for use as the wavelength converting material include luminescent materials based on perylene derivatives, which are for instance sold under the brand name Lumogen® by BASF. Examples of suitable commercially available products thus include, but are not limited to, Lumogen® Red F305, Lumogen® Orange F240, Lumogen® Yellow F170, and combinations thereof.

Examples of inorganic phosphors suitable for the wavelength converting material include, but are not limited to, cerium doped yttrium aluminum garnet ($Y_3Al_5O_{12}:Ce^{3+}$, also referred to as YAG:Ce or Ce doped YAG) or lutetium aluminum garnet (LuAG; $Lu_3Al_5O_{12}$), α-SiAlON:$Eu^{2+}$ (yellow), and $M_2Si_5N_8:Eu^{2+}$ (red) wherein M is at least one element selected from calcium Ca, Sr and Ba. Another example of an inorganic phosphor that may be used in embodiments of the invention, typically in combination with a blue light emitting light source, is YAG:Ce. Furthermore, a part of the aluminum may be substituted with gadolinium (Gd) or gallium (Ga), wherein more Gd results in a red shift of the yellow emission. Other suitable materials may include $(Sr_{1-x-y}Ba_xCa_y)_{2-z}Si_{5-a}Al_aN_{8-a}O_a:Eu_z^{2+}$ wherein $0 \le a < 5$, $0 \le x \le 1$, $0 \le y \le 1$ and $0 < z \le 1$, and $(x+y) \le 1$, such as $Sr_2Si_5N_8:Eu^{2+}$ which emits light in the red range.

Optionally the wavelength converting member may also comprise scattering elements, e.g. particles of $Al_2O_3$ or $TiO_2$.

The person skilled in the art realizes that the present invention by no means is limited to the preferred embodiments described above. On the contrary, many modifications and variations are possible within the scope of the appended claims. For example, although the drawings show embodiments using a plurality of light sources, it is possible in some embodiments to use only a single light source, or a single light source where a group of light sources is designated in the present drawings, as will be appreciated by a person skilled in the art. For example, a single light source may be used instead of the group of light sources 101, and/or a single light source may replace the first group of light sources 201*a*, 301*a*, 501*a*, and/or a single light source may replace the second group of light sources 201*b*, 301*b*, 501*b*, respectively. Furthermore, although the illustrated embodiments show wavelength converting elements positioned at a certain distance from the light sources (so-called remote phosphor configuration) it is envisaged that the wavelength converting member, which may also be a plurality of wavelength converting members, could be arranged closer to the light sources or even arranged directly on the light sources, in particular where quantum dots are used for wavelength conversion.

Other contemplated applications, in addition to street lights, for the light emitting arrangements described herein include vehicle headlights, in particular bicycle lights, and torch (flash) lights, typically a handheld torch light.

Additionally, variations to the disclosed embodiments can be understood and effected by the skilled person in practicing the claimed invention, from a study of the drawings, the disclosure, and the appended claims. In the claims, the word "comprising" does not exclude other elements or steps, and the indefinite article "a" or "an" does not exclude a plurality. The mere fact that certain measures are recited in mutually different dependent claims does not indicate that a combination of these measured cannot be used to advantage.

The invention claimed is:

1. A light emitting arrangement, comprising:

a plurality of solid state light sources, arranged to provide a light distribution comprising a first light portion and a second light portion, wherein said solid state light sources emit light of a first wavelength range having a dominant wavelength of 477-537 nm;

at least one optical component extending from the plurality of solid state light sources in a direction of the light distribution, the at least one optical component having a narrowest portion proximate the plurality of solid state light sources and a widest portion proximate the light distribution, the at least one optical component adapted to at least partly collimate light emitted by said light sources, to yield output light exiting the light emitting arrangement comprising central output light and peripheral output light, wherein the peripheral output light is distinct from and located a larger lateral distance from an optical axis of the light emitting arrangement than the central output light, wherein said central output has a dominant wavelength of 535-575 nm and a light intensity of at least 3 cd/m2, and said peripheral output light has a dominant wavelength of 477-537 nm and a light intensity of less than 3 cd/m2; and at least a first wavelength converting member configured to convert light of said first wavelength range into light of a second wavelength range having a dominant wavelength of 535-575 nm, and being arranged to receive and at least partially convert said first light portion provided by said plurality of solid state light sources and arranged to allow said second light portion emitted by said solid state light sources to pass beside said first wavelength converting member, wherein the first wavelength converting member is arranged at the narrowest portion of the at least one optical component.

2. The light emitting arrangement according to claim 1, wherein a first group of the plurality of solid state light sources provides said central portion of output light, and a second group of the plurality of solid state light sources provides said peripheral portion of output light.

3. The light emitting arrangement according to claim 2, wherein light emitted by at least one first solid state light source is received by said first wavelength converting member, and wherein light emitted by at least one second solid state light source is not received by said first wavelength converting member.

4. The light emitting arrangement according to claim 1, further comprising a second wavelength converting member arranged to receive said peripheral light portion and comprising a second wavelength converting material capable of converting light of said first wavelength range into light of a third wavelength range, wherein said third wavelength range has a dominant wavelength of 477-537 nm.

5. The light emitting arrangement according to claim 1, comprising a first optical component arranged to at least partly collimate said first light portion to form said central output light, and a second optical component arranged to at least partly collimate said second light portion to form said peripheral output light, wherein said second optical component provides a wider angular distribution of light than said first optical component.

6. The light emitting arrangement according to claim 1, comprising a reflector arranged to direct light of said second wavelength range towards a central light exit window of the light emitting arrangement, to form said central output light.

7. The light emitting arrangement according to claim 1, comprising a reflector arranged to direct light of said second light portion towards an outer light exit window of the light emitting arrangement, to form said peripheral output light.

8. The light emitting arrangement according to claim 1, wherein the wavelength converting member comprises quantum dots.

9. A lamp or luminaire comprising a light emitting arrangement according to claim 1.

10. A street light comprising a light emitting arrangement according to claim 1.

11. A torch light comprising a light emitting arrangement according to claim 1.

12. A headlight for a vehicle, comprising a light emitting arrangement according to claim 1.

13. The light emitting arrangement according to claim 1, comprising a refractive optical component arranged to direct light of said second wavelength range towards a central light exit window of the light emitting arrangement, to form said central output light.

14. The light emitting arrangement according to claim 1, comprising a refractive optical component arranged to direct light of said second light portion towards an outer light exit window of the light emitting arrangement, to form said peripheral output light.

15. The light emitting arrangement according to claim 1, wherein the plurality of solid state light sources comprises a first group of solid state light sources and a second group of solid state light sources and said first wavelength converting member is arranged over the first group of solid state light sources but not the second group of solid state light sources.

16. A light emitting arrangement, comprising:

a plurality of solid state light sources, arranged to provide a light distribution comprising a first light portion and a second light portion, wherein said solid state light sources emit light of a first wavelength range having a dominant wavelength of 477-537 nm;

at least one optical component extending from the plurality of solid state light sources in a direction of the light distribution, the at least one optical component having a narrowest portion proximate the plurality of solid state light sources and a widest portion proximate the light distribution, the at least one optical component adapted to at least partly collimate light emitted by said light sources, to yield output light exiting the light emitting arrangement comprising central output light and peripheral output light, wherein the peripheral output light is distinct from and located outside the central output light, wherein said central output has a dominant wavelength of 535-575 nm and a light intensity of at least 3 cd/m2, and said peripheral output light has a dominant wavelength of 477-537 nm and a light intensity of less than 3 cd/m2; and at least a first wavelength converting member configured to convert light of said first wavelength range into light of a second wavelength range having a dominant wavelength of 535-575 nm, and being arranged to receive and at least partially convert said first light portion provided by said plurality of solid state light sources and arranged to allow said second light portion emitted by said solid state light sources to pass beside said first wavelength converting member, wherein the plurality of solid state light sources comprises a first group of solid state light sources providing said central output light and a second group of solid state light sources providing said peripheral output light, wherein light emitted by at least one solid state light source of said first group is received by said first wavelength converting member, and wherein light emitted by at least one solid state light source of said second group is not received by said first wavelength converting member, and wherein said at least one solid state light source of said first group is arranged within a first light mixing chamber and said wavelength converting member forms a light exit window of said first light mixing chamber, and said at least one solid state light source of said second group is arranged outside of said first light mixing chamber.

* * * * *